US006920664B2

(12) United States Patent
Libman et al.

(10) Patent No.: US 6,920,664 B2
(45) Date of Patent: Jul. 26, 2005

(54) MOP WITH ATTACHED WRINGER CUP

(75) Inventors: Robert J. Libman, Champaign, IL (US); Enzo Berti, Dolo/Venice (IT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 10/356,896

(22) Filed: Feb. 3, 2003

(65) Prior Publication Data

US 2003/0213079 A1 Nov. 20, 2003

Related U.S. Application Data

(63) Continuation-in-part of application No. 29/145,583, filed on Jul. 25, 2001, now Pat. No. Des. 474,869.

(51) Int. Cl.[7] ..... A47L 13/14
(52) U.S. Cl. ..... 15/120.1; 15/119.1
(58) Field of Search ..... 15/116.1, 119.1, 15/120.1, 120.2

(56) References Cited

U.S. PATENT DOCUMENTS

| | | | | | |
|---|---|---|---|---|---|
| 1,273,768 | A | * | 7/1918 | Gillam | 15/120.2 |
| 3,462,788 | A | * | 8/1969 | Abbott | 15/119.1 |
| 5,060,338 | A | | 10/1991 | Yates et al. | 15/119.2 |
| D387,526 | S | | 12/1997 | Berti et al. | D32/51 |
| 5,976,266 | A | * | 11/1999 | Anderson et al. | 134/6 |

FOREIGN PATENT DOCUMENTS

| | | | |
|---|---|---|---|
| ES | 2117588 | * | 8/1998 |
| GB | 1586313 | * | 3/1981 |

* cited by examiner

*Primary Examiner*—Mark Spisich
(74) *Attorney, Agent, or Firm*—Banner & Witcoff, Ltd.

(57) ABSTRACT

A mop with an attached wringer cup has a set of perforations near the outwardly tapering lower end of the wringer cup. The perforations have a width that is equal to about one-third the diameter of the handle, and less than the width of the flat mop strips that form the mop elements on the end of the handle. The upper end of the wringer cup fits within a lower part of a handgrip on the handle.

10 Claims, 4 Drawing Sheets

MOP WITH ATTACHED WRINGER CUP

This is continuation-in-part of Ser. No. 29/145,583, filed on Jul. 25, 2001, now U.S. Pat. No. D47,869. The present invention relates generally to mops, and more particularly to mops with attached wringer cups.

BACKGROUND OF THE INVENTION

One type of mop that has found commercial success is in the marketplace is a mop having an attached wringer cup, like the one disclosed in U.S. Pat. No. 5,060,338. Other examples may be found in U.S. Pat. Nos. 1,709,622; 3,364,512; 3,946,457; and 4,809,287; and German published patent application no. DE 3607121 A1.

The wringer cups used on these kinds of mops often have grooves or ribs on the inside. When the cone-shaped wringer cup is pushed down over the mop fibers, the ribs help to squeeze water out of the mop fibers. The wringing is not always completely effective, however. Some of the water that has been squeezed out of the mop fibers can sometimes re-enter the fibers before draining completely out of the wringer cup.

SUMMARY OF THE INVENTION

The applicant has developed an innovative wringer cup for such mops. The cup has holes in it that may permit water to drain out of the wringer cup quicker.

BRIEF DESCRIPTION OF THE DRAWINGS

The invention may be better understood by referring to the accompanying drawings, in which.

DETAILED DESCRIPTION OF THE DRAWINGS

Figure 1:
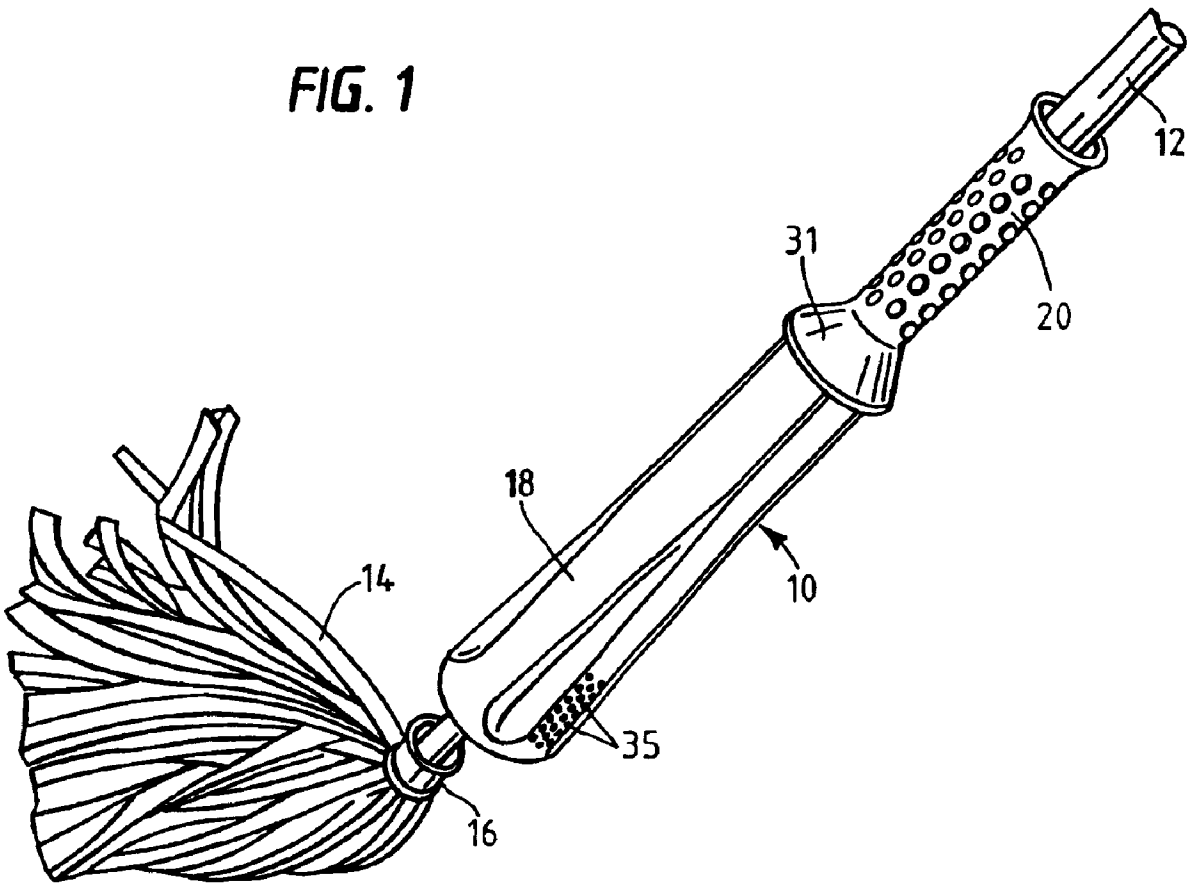
FIG. 1 is a perspective view of a wringer mop in accordance with one embodiment of the invention.

FIGS. 1–4 show one embodiment of a mop 10 in accordance with the present invention. Like conventional wringer mops, the illustrated mop includes a handle 12, a set of mop elements 14 on an end 16 of the handle, and a wringer cup 18.

It is conventionally known that the handle for such mops can be a lightweight metal tube. The illustrated handle includes an optional hand grip 20, discussed below.

The mop elements 14 that are illustrated take the form of flat strips. It is conventionally known that such strips can be made from (for example) water-absorbing nonwoven fibrous material that is around 18 or 19 inches long and about 0.15 inch thick in its noncompressed state. Other materials could also be used.

Figure 3:
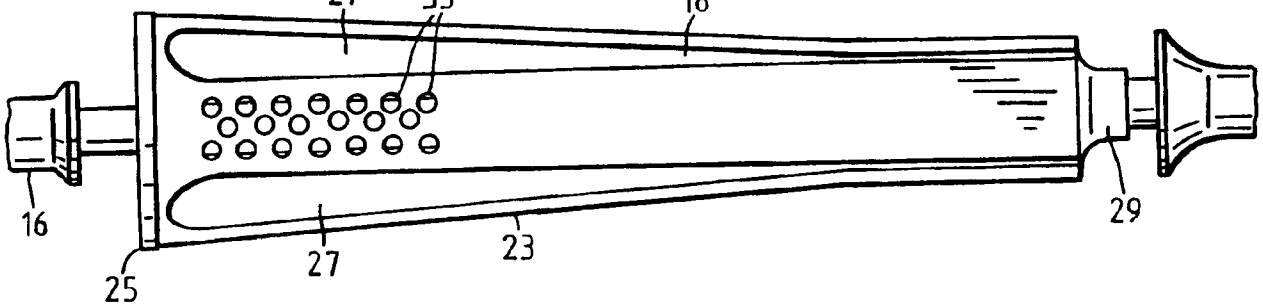
FIG. 3 is an enlarged side elevational view of the wringer cup seen in FIG. 1.
Figure 4:
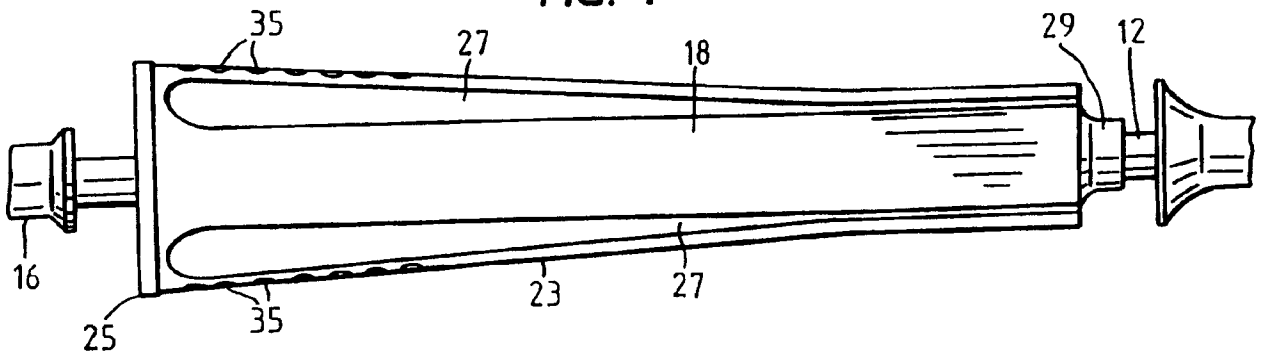
FIG. 4 is a rotated side view of the wringer cup.

As seen in FIGS. 3 and 4, the illustrated wringer cup 18 is disposed on the handle 12 above the mop elements 14, and has an outer wall 23 that tapers outwardly toward a lower end 25. The precise shape and arrangement of the wringer cup is not important to the invention. It is conventionally known that wringer cups used on such mops are preferably slidably mounted on the handle, and may take the form of a tubular shell that can be molded in one piece from a polymeric material such as polypropylene. It is also conventionally known that such wringer cups may include ribs 27 that help to squeeze liquid from the mop fibers during wringing.

Figure 2:
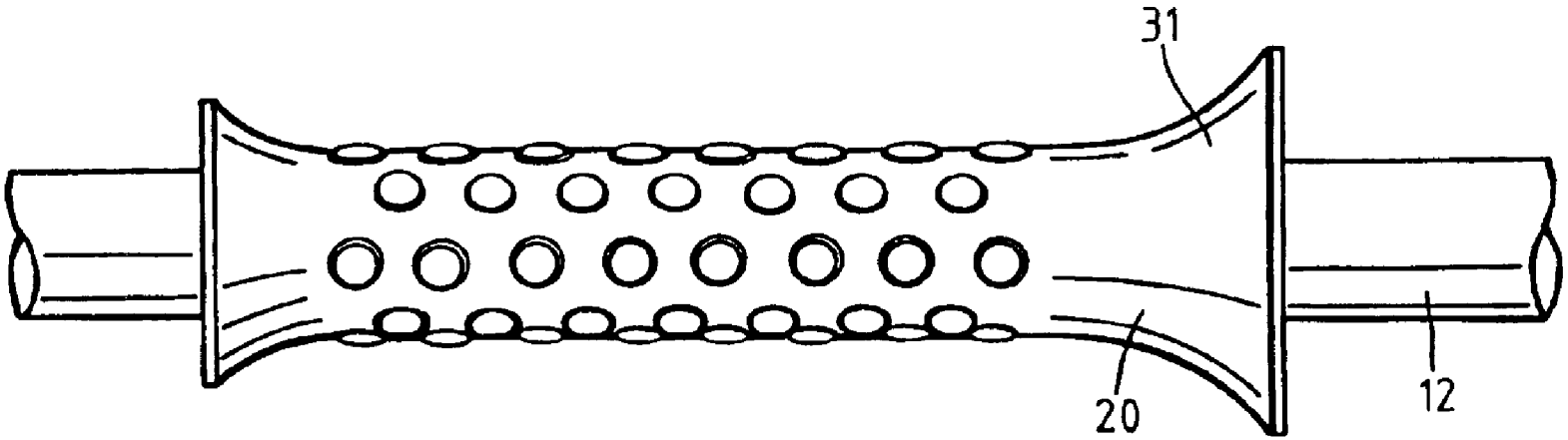
FIG. 2 is an enlarged side elevational view of the handgrip seen in FIG. 1.

The optional hand grip 20 that has been illustrated in FIG. 2 is mounted on the handle 12, above the mop elements 14. The hand grip is arranged to hold the wringer cup 18 above the mop elements fibers when the mop is being used. This position is illustrated in FIG. 1, in which an upper portion 29 of the wringer cup (seen in FIG. 3) fits within a lower part 31 of the handgrip.

Figure 5:
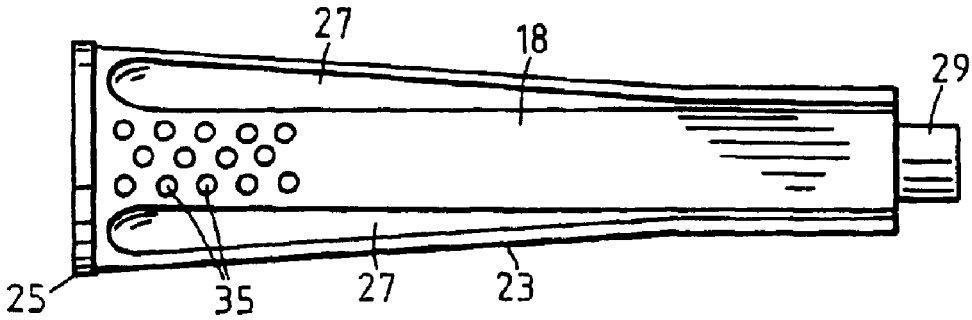
FIG. 5 is an enlarged side elevational view of an alternative embodiment of the wringer cup.
Figure 6:
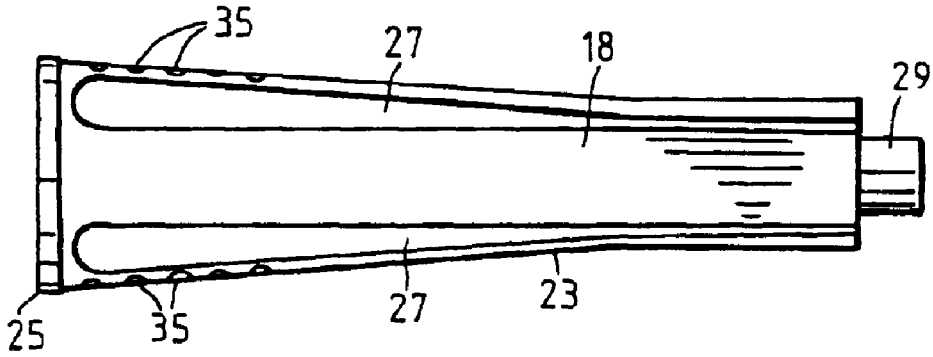
FIG. 6 is a rotated side view of the alternative embodiment.

The present mop 10 differs from previously known mops with wringer cups in the perforations 35 on the outer wall 23 of the wringer cup 18. As best seen in FIGS. 1, 3, and 5, the illustrated perforations are disposed near the lower end 25 of the wringer cup. As seen in FIGS. 1 and 3, the illustrated perforations have a width that is equal to about one-third the diameter of the handle 12, and is less than the width of the flat strips that form the mop elements 14 on the end of the handle.

This detailed description has been given for clearness of understanding only. Modifications may be obvious to those skilled in the art. The intended scope of the invention is set forth in the following claims.

What is claimed is:

1. A mop with attached wringer cup camp comprising:

a handle;

a set of mop elements on an end of the handle; and a wringer cup having an upper end and a lower end, the lower end positioned outwardly of the upper end with respect to the end of the handle, a plurality of elongated ribs and a plurality of wall portions between adjacent ribs, the ribs being inwardly directed toward the handle with respect to the wall portions, and a plurality of perforations on the wall portions near the lower end of the wringer cup the elongated ribs being free of any such perforations.

2. A mop with attached wringer cup as recited in claim 1, in which the perforations have a width that is less than the width of the mop elements.

3. A mop with attached wringer cup as recited in claim 1, in which the perforations have a width that is no more than about one-third the diameter of the handle.

4. A mop with attached wringer cup as recited in claim 1, in which the perforations have a width equal to about one-third the diameter of the handle.

5. A mop with attached wringer cup as recited in claim 1, and further comprising a hand grip that is adapted to hold the wringer cup above the mop elements.

6. A mop with attached wringer cup as recited in claim 5, in which the upper end of the wringer cup fits within a lower portion of the hand grip.

7. A mop with attached wringer cup as recited in claim 1, in which the plurality of wall portions taper outwardly toward the lower end.

8. A mop with attached wringer cup as recited in claim 1, in which the wall portions are outwardly-curving.

9. A mop with attached wringer cup as recited in claim 1, in which the mop elements comprise a plurality of flat strips.

10. A mop with attached wringer cup comprising:

a handle with a hand grip;

a set of flat mop strips on an end of the handle;

a wringer cup having a plurality of elongated ribs and a plurality of wall portions between adjacent rib, the ribs being inwardly directed toward the handle with respect to the wall portions, the wall portions tapering outwardly toward a lower end, one or more of the wall portions having a set of circular perforations near only the lower end, the elongated ribs being free of any such perforations, the perforations having a width equal to about one-third the diameter of the handle, the wringer cup having an upper end that fits within a lower part of the handgrip.

* * * * *